US007126985B2

(12) United States Patent
Horst et al.

(10) Patent No.: US 7,126,985 B2
(45) **Date of Patent: *Oct. 24, 2006**

(54) METHOD AND APPARATUS FOR ASSIGNING ADDRESSES TO COMPONENTS IN A CONTROL SYSTEM

(75) Inventors: Folkert Horst, Pierrefonds (CA); Andre Brousseau, Chateauguay (CA); Oleh Szklar, St. Hubert (CA); Luc Ethier, St-Eustache (CA)

(73) Assignee: Cattron Intellectual Property Corporation, Sharpsville, PA (US)

( * ) Notice: Subject to any disclaimer, the term of this patent is extended or adjusted under 35 U.S.C. 154(b) by 646 days.

This patent is subject to a terminal disclaimer.

(21) Appl. No.: 10/163,199

(22) Filed: Jun. 4, 2002

(65) Prior Publication Data

US 2003/0202621 A2 Oct. 30, 2003

Related U.S. Application Data

(63) Continuation of application No. 09/281,464, filed on Mar. 30, 1999.

(30) Foreign Application Priority Data

Mar. 25, 1999 (CA) ..... 2266998

(51) Int. Cl.
*H04B 1/38* (2006.01)
*H04L 5/16* (2006.01)

(52) U.S. Cl. ..... 375/222; 375/219; 701/19

(58) Field of Classification Search ..... 375/259, 375/219, 220, 222; 701/19, 20; 340/5.5, 340/825.69; 359/154, 142, 144, 145
See application file for complete search history.

(56) References Cited

U.S. PATENT DOCUMENTS

| | | | |
|---|---|---|---|
| 3,639,755 | A | 2/1972 | Wrege |
| 4,245,347 | A | 1/1981 | Hutton et al. |
| 4,264,954 | A | 4/1981 | Briggs et al. |
| 4,529,980 | A | 7/1985 | Liotine et al. |
| 4,553,723 | A | 11/1985 | Nichols et al. |
| 4,582,280 | A | 4/1986 | Nichols et al. |
| 4,687,258 | A | 8/1987 | Astley |
| 4,912,463 | A | 3/1990 | Li |

(Continued)

FOREIGN PATENT DOCUMENTS

DE 36 18 464 A1 12/1987

(Continued)

OTHER PUBLICATIONS

Skylar, "Digital Communications Fundamentals and Applications" Prentice Hall Inc., 1988, pp. 4-5, 51 and 78-81.

*Primary Examiner*—Phuong Phu
(74) *Attorney, Agent, or Firm*—Merchant & Gould P.C.

(57) ABSTRACT

The invention relates to a method and an apparatus for remotely controlling device, more particularly to a system and method for controlling locomotives in a railway environment using radio frequency signals. This invention makes use of a remote operator programming unit (OPP) to set address information in the transmitter unit via a communication channel such as an infrared link. The use of the operator programming unit allows eliminating the need to open the casing of the transmitter during programming thereby reducing the probability of damaging the electrical components of the transmitter. The invention also allows assigning a unique address to a transmitter/receiver pair in a remote control system. The invention further provides an apparatus for remotely programming a transmitter unit.

20 Claims, 6 Drawing Sheets

U.S. PATENT DOCUMENTS

| | | | |
|---|---|---|---|
| 5,039,038 | A | 8/1991 | Nichols et al. |
| 5,122,948 | A | 6/1992 | Zapolin |
| 5,495,520 | A | 2/1996 | Kojima |
| 5,511,749 | A | 4/1996 | Horst et al. |
| 5,533,695 | A | 7/1996 | Heggestad et al. |
| 5,570,284 | A | 10/1996 | Roselli et al. |
| 5,681,015 | A | 10/1997 | Kull |
| 5,685,507 | A | 11/1997 | Horst et al. |
| 5,729,210 | A | 3/1998 | Kiriyama |
| 5,746,261 | A | 5/1998 | Bowling |
| 5,815,823 | A | 9/1998 | Engle |
| 5,884,146 | A | 3/1999 | Simmons |
| 6,218,961 | B1 | 4/2001 | Gross et al. |
| 6,275,739 | B1 | 8/2001 | Ireland |
| 6,314,345 | B1 | 11/2001 | Coombes |
| 6,400,281 | B1 | 6/2002 | Darby, Jr. et al. |
| 6,449,536 | B1 | 9/2002 | Brousseau et al. |
| 6,456,674 | B1 | 9/2002 | Horst et al. |

FOREIGN PATENT DOCUMENTS

| | | |
|---|---|---|
| DE | 42 42 231 | 6/1994 |
| EP | 326 630 | 8/1989 |
| EP | 704 590 | 4/1996 |
| WO | WO 96/36953 | 11/1996 |

METHOD AND APPARATUS FOR ASSIGNING ADDRESSES TO COMPONENTS IN A CONTROL SYSTEM

CROSS-REFERENCE TO RELATED APPLICATION

This application is a continuation of U.S. patent application Ser. No. 09/281,464 filed Mar. 30, 1999.

FIELD OF THE INVENTION

This invention relates to the field of communication and control systems. It is particularly applicable to a method and apparatus for assigning machine addresses to computer or electronically controlled devices, and may be used to assign machine addresses to a control system using radio communication to transmit commands between a master controller and a slave controller.

BACKGROUND OF THE INVENTION

Electronic controllers are commonly used in the industry to regulate the operation of a wide variety of systems. In a specific example, electronic controllers are used to control remotely vehicles such as locomotives in order to perform functions including braking, traction control and acceleration without the necessity of a human operator on board the locomotive. Radio frequency transmitter-receiver pairs are of particular interest for remotely controlling such vehicles.

In a typical locomotive control system, the operator communicates with a slave controller onboard the locomotive using a remote control device, herein designated as transmitter. The transmitter includes an electronic circuit placed in a suitable casing that provides mechanical protection to the electronic components.

In use, the operator of the locomotive enters requests into the transmitter via an input means such as a keyboard, touch screen or any other suitable input means. Typical requests may include braking, accelerating and any other function that a locomotive may be required to perform. The transmitter encodes the request into a form suitable for transmission over a pre-determined frequency link. Usually, a tag is appended to the request containing an identifier, herein designated as an address, unique to the remote control transmitter from which the request originates. The complete request is then modulated at the pre-determined radio frequency and transmitted as a RF signal. Frequencies other than RF have also been used for this purpose.

Commonly, many transmitters may operate on the same radio frequency channel or on overlapping radio frequency channels often resulting in interference between the various signals. Signals transmitted in overlapping frequency channels cannot be resolved into their respective signals by the slave controller. The interference of the signals typically causes requests to be lost. Consequently, a request is often transmitted continuously at a given repetition rate and each transmitter is assigned a unique repetition rate. The unique repetition rate reduces the likelihood of messages interfering with one another. Many methods of assigning transmission rates are well-known in the art to which this invention pertains. For an example of a method of assigning a repetition rate, the reader may refer to U.S. Pat. No. 4,245,347 by Hutton et al., whose content is hereby incorporated by reference.

Optionally, once the transmitter sends the RF signal, a repeater unit may receive the RF signal. Typical repeater units are ground-based units whose function is to extend the radio frequency (RE) range of the transmitter of the remote control device by amplifying the signal and filtering noise components. Repeater units are well-known in the art to which this invention pertains and typically comprise an RF antenna, an RF receiver, a decoder/encoder, an RF re-transmitter and any other equipment such as filters, duplexors and others required to receive a signal, process it and retransmit it. Commonly, the repeater unit re-transmits the signal at a frequency different from the frequency used by the transmitter, as well as sufficiently spaced in frequency from the frequency used by the transmitter such that the two signals can be resolved if they are received simultaneously by a receiver unit.

The slave controller onboard the locomotive receives and demodulates the RF signal originating from the transmitter or from the repeater unit. The signal is then decoded and the validity of the request is verified. The slave controller stores an identifier indicative of the machine address of the transmitter assigned to the locomotive. The identifier is compared to the tag contained in the received demodulated request. Another operation in the verification of the signal involves verifying if the signal is intact by using a check sum or other suitable error detection or correction algorithm. If the signal is valid, it is then processed further so the command contained in the request can be implemented.

Locomotive control systems of the type described above require the involvement of a human administrator that assigns and keeps a record of the various machine addresses of the transmitters in use. Generally, to assign an address to a transmitter or to a slave controller, dip switches within the transmitter and the slave controller are physically set. The position of the dip switches defines the machine address assigned to the transmitter. Similarly, at the slave controller, dip switches are provided to define the address of the transmitter permitted to communicate with the receiver. Occasionally, such transmitters/receivers need to be replaced or temporarily removed from service to perform maintenance. For instance, in order to assign an address to a new transmitter module, the casing of the transmitter must be opened and the dip switches must be correctly set by the human operator. The setting is such that the machine address of the previous transmitter is duplicated on the new unit so the latter can communicate with the slave controller in the field.

The first problem with transmitter units of the type described above is the requirement to open the transmitter casing in order to access the dip switches. Such an operation, unless performed carefully, can compromise the integrity of the casing. For example, if the casing is waterproof, opening it may damage the watertight seal, thus increasing the risk of premature component failure.

The second problem with transmitter units of the type described above is the high reliance upon a technician to physically set the machine address by manipulating the dip switches. The reliance on an operator to assign addresses makes the system highly susceptible to human errors. For example, a technician may erroneously give two transmitter units the same machine address resulting in conflicting signals by setting the dip switches in the inappropriate position. Finally, a human operator is required to assign and manage the addresses of the transmitters in order to insure that no two transmitters are given the same address. Consequently, the assignment and management of addresses by an operator is a time consuming task resulting in significant labour costs.

Thus, there exists a need in the industry to refine the process of assigning a machine address to a component of a control system such as to maintain the integrity of the components, reduce the possibility of human error and reduce the involvement of a human operator for the management of the addresses.

SUMMARY OF THE INVENTION

For the purpose of this specification, the expressions "random" and "substantially random" are used to define a numerical pattern with very low correlation between its composing elements. In computer applications, random numbers are often generated using a mathematical formula that attempts to approach the "purely random" behaviour. However, in the context of this specification this expression should be given a broad interpretation to mean any non-numerically organised sequence of numbers or any other characters or symbols.

The present invention provides a novel operator programming unit (OPP) allowing performing address synchronisation between a transmitter and a slave controller, particularly in the context of a remote control system. The transmitter and the slave controller are assigned identical addresses. When the transmitter issues a command, the address is embedded in the signal. The slave controller receives the signal and will process it only when the embedded address matches the locally stored address information. This feature constrains the slave controller to accept commands only from designated transmitters.

The address has two parts. One part is an identifier of the transmitter, the other part is an identifier from the slave controller. When these two parts are assembled, the combination forms a unique address for the pair transmitter/slave controller.

The operator programming unit (OPP) is designed to communicate with one of the devices, say the slave controller, to gather its identifier. Next, the operator programming unit communicates with the other device, say the transmitter, to transmit to it the identifier of the slave controller. Preferably, at the same time, the operator programming unit gathers the identifier of the transmitter. Finally, the operator programming unit then communicates with the slave controller to communicate to it the identifier of the transmitter. This procedure allows effecting an identifier exchange between the devices such that they all possess the same parts of the address. Accordingly, both the transmitter and the slave controller will have the same address information allowing interoperability to take place. In addition, by automatically assigning unique identifiers to transmitters and slave controllers, a one-to-one correspondence between selected transmitter-slave pairs can be achieved.

The invention also provides a novel transmitter for use in a remote control system featuring a dual part address, one part being proper to the transmitter and one part being proper to a slave controller to which the transmitter issues commands.

The invention yet provides a novel slave controller for use in a remote control system featuring a dual part address, one part being proper to the slave controller and one part being proper to the transmitter that issues commands to the slave controller.

Finally, the invention also provides a novel remote control system including a transmitter and a slave controller, the system using a dual part address to effect command validation.

BRIEF DESCRIPTION OF THE DRAWINGS

These and other features of the present invention will become apparent from the following detailed description considered in connection with the accompanying drawings. It is to be understood, however, that the drawings are provided for purposes of illustration only and not as a definition of the boundaries of the invention for which reference should be made to the appended claims.

DESCRIPTION OF A PREFERRED EMBODIMENT

Figure 1:
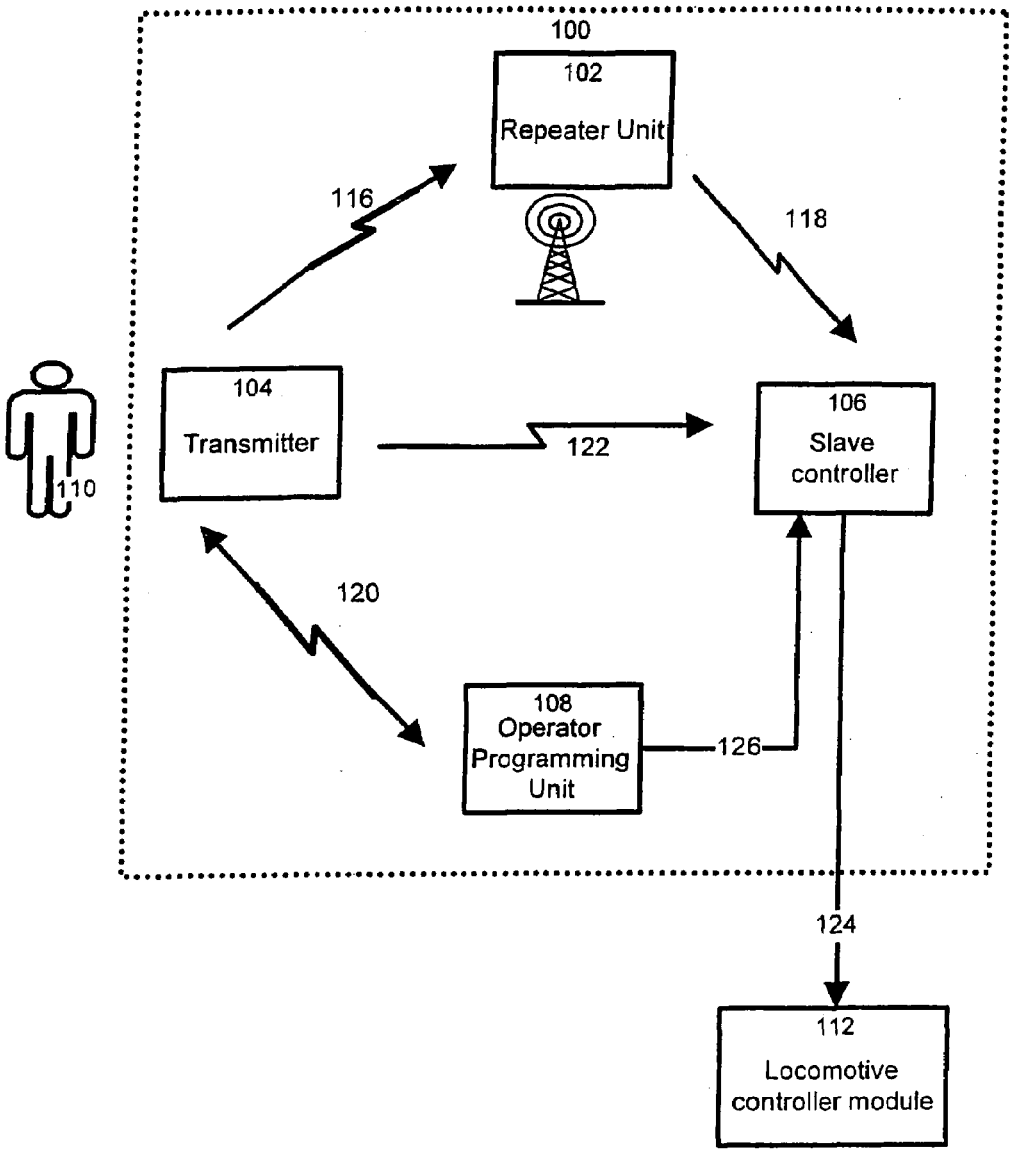
FIG. 1 shows a simplified functional block diagram of a radio communication system including an embodiment of the invention.

In a preferred embodiment of this invention, the method for assigning an address to a communication component is used in a remote control system such as can be used in a locomotive control system. As shown in FIG. 1, the remote control system 100 includes a set of functional units namely a portable transmitter 104 and a slave controller 106 mounted on board the locomotive. The transmitter 104 has an interface allowing an operator 110 to enter commands. Typically, the interface includes a control panel with switches and levers allowing the operator 110 to remotely control the movement of the locomotive. Optionally, the remote control system 100 may also include a repeater unit 102 to increase the effective operational range between the transmitter 104 and the slave controller 106.

The transmitter 104 generates command signals over an RF link 122 (or 116 and 118 if the repeater unit 102 is involved) The slave controller 106 receives the commands and implements them. The implementation procedure consists of generating the proper control signals and interfacing those control signals with the main controller module 112 provided in the locomotive to regulate the operation of the engine, braking system and other devices.

The remote control system 100 includes an operator programming unit 108 (OPP) to program certain functions of transmitter 104 and the slave controller 106. The programming operation between the OPP 108 and the slave controller 106 is effected over a communication link 126. The programming operation between the OPP 108 and the transmitter 104 is effected over a communication link 120. The communication link 120 is a wireless infrared (1R) link. Other communication links are possible. For example, the communication link 120 between the OPP 108 and the transmitter 104 may be based on RF communication. In a preferred embodiment, the controller module 112 and the OPP 108 communicate with the slave controller 106 via standard asynchronous serial communication links 126, 124 or any other suitable communication links.

The repeater unit 102 is a ground-based unit whose function is to extend the radio frequency (RF) range of the transmitter 104. In a specific example, the signal range is extended by amplifying the signal and filtering noise components. Repeater units are well-known in the art to which this invention pertains and typically comprise an RF antenna, an RF receiver, a decoder/encoder, an RF retransmitter and any other equipment such as filters, duplexors and others required to receive a signal, process it and retransmit it. Preferably, the repeater unit re-transmits the signal at a frequency different and sufficiently spaced in frequency from the one used by the transmitter 104 such that the two signals can be resolved when the slave controller 106 receives them.

In a specific example the radio frequencies used are between 806 MHz and 821 MHz (low band) or between 851 MHz and 866 MHz (high band) and frequencies are selected in pairs one from the low band and one from the high band. Any suitable frequency band may be used here without detracting from the spirit of the invention. The transmitter unit 104 operates at a frequency selected from the low band and the repeater unit 102 retransmits at a frequency selected from the high band. Examples of three frequency pairs are 1) 812.5375 MHz and 857.5375 MHz, 2) 812.7875 MHz and 857.7875 MHz, 3) 818.900 MHz and 863.900 MHz.

The slave controller 106 receives and demodulates the RF signal originating from the transmitter 104 or from the repeater unit 102. The signal is then decoded and the validity of the request is verified. The signal is first demodulated and the components of the message are extracted. In a specific example, the message contains a command section, a transmitter identifier section and a slave controller identifier. These components are extracted from the message in a known manner. The validity verification on the message then follows. This is a two-step operation. First, the slave controller 106 determines if the transmitter 104 transmitting the message is permitted to issue commands to the slave controller 106. Second, the signal integrity is verified. The first verification step involves a comparison between the tag extracted from the message and the value stored in the memory of the slave controller 106. In typical locomotive control systems, a single transmitter 104 can issue commands to a given locomotive. Generally, a memory element in the slave controller 106, such as a register stores an identifier indicative of the transmitter assigned to the locomotive. The identifier is compared to the tag extracted from the message. If both match, the slave controller 106 concludes that the command is legitimate and proceeds with the remaining verification step. In the absence of match, the slave controller 106 rejects the message and takes no action.

During the second verification step, the signal integrity is assessed. The signal is processed by a check sum assessment algorithm or by any other suitable error detection/correction algorithm. If the slave controller 106 finds that the message is indeed intact then the command that it contains is carried into effect.

Figure 2:
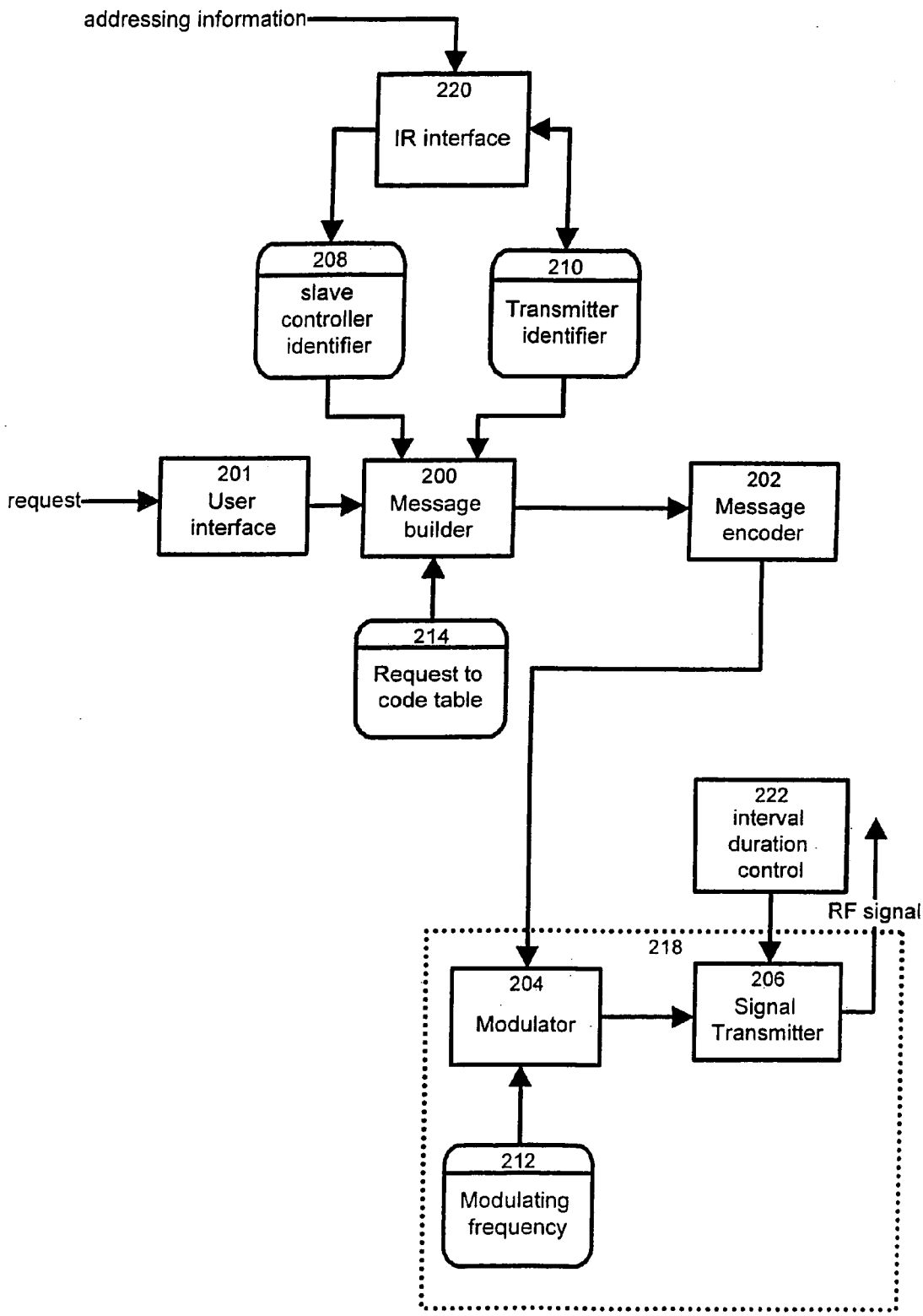
FIG. 2 shows a functional block diagram of a transmitter unit in accordance with the spirit of the invention.

The transmitter 104 of the remote control system 100 is shown in more detail in FIG. 2. The transmitter 104 comprises a set of functional modules namely a user interface 201, a message builder unit 200, a message encoder 202 and a signal transmitting unit 218. The signal transmitting unit 218 includes an input for receiving the signal to be transmitted. The signal is supplied to a modulator 204 that modulates the signal and transfers it to a signal transmitter 206 that effects the actual transmission. The modulator 204 is coupled to a modulating frequency generator 212. The signal transmitter 206 is coupled to a time interval duration control module 222. The time interval duration control module 222 stores data for controlling the time interval between two successive transmissions of the signal.

In a typical interaction, the user of the remote control system 100 enters via the user interface 201 a command to be executed by the locomotive. The user interface 201 may be a keyboard, touch screen, speech recognition system or any other suitable input means. In a preferred embodiment, the user interface 201 comprises a set of buttons or levers for each of the allowable actions namely braking, accelerating, reversing and so on. Once the command has been entered the message builder unit 200 processes it. The message builder unit 200 assembles the received command with an identifier for the transmitter as well as for the slave controller. These two identifiers are stored in computer readable storage media 210 and 208. Such computer readable storage media are in the form of a read-only memory (ROM), programmable read-only memory (PROM) modules, EPROM or any other suitable register devices. The command and the identifiers are digitally represented. Many message formats may be used here and the use of a particular message format does not detract from the spirit of the invention.

The transmitter unit 104 includes an infrared interface 220 coupled to the storage media 208, 210 storing the identifiers 208 210. The IR interface 220 receives address information via the IR communication link 120. In a specific example, the identifier information is sent by the OPP 108. In an alternative embodiment, an asynchronous transmission link (e.g. RS232) can be used instead of the IR interface 220.

Each transmitter 104 is assigned a unique transmission address. In a specific example, the transmission address, herein designated as address, assigned to the transmitter 104 depends on the identifier assigned to the slave controller. The transmitter 104 uses this address in the tag sent along with each message. In a preferred embodiment, the address is a compound data element including the slave controller identifier and the transmitter identifier. In a specific example, the identifiers are the serial numbers of the respective components. Since a serial number is generally unique over all components, the address will be unique. Following this, the address is placed on the tag, which is added to the message.

Optionally, once the message is created (the command including the tag), an encoding algorithm is applied by the message encoder 202 in order to reduce the occurrence of consecutive 0's or 1's in the message and therefore permit a self-synchronizing communication. Many encoding methods are known in the art of digital signal processing and the use of other encoding methods does not detract from the spirit of the invention.

Once the message has been created, the message is passed to the signal transmitting unit 218, in particular to the modulator 204 that modulates the digital signal containing the message at the carrier frequency. In a preferred embodiment, the operator of the transmitter 104 may select the carrier frequency for the message. The carrier frequency generator 212 outputs the selected carrier frequency. Following the modulation of the signal, a signal transmitter module 206 transmits the signal at predetermined time intervals. The time interval control module 222 controls the time interval between two successive signal transmission events.

The OPP 108 is a module used for performing address synchronization between the transmitter 104 and the slave controller 106. The OPP 108 is used to load the information representative of addresses into the transmitter 104 and the slave controller 106 such as to uniquely define the pair.

Figure 5:
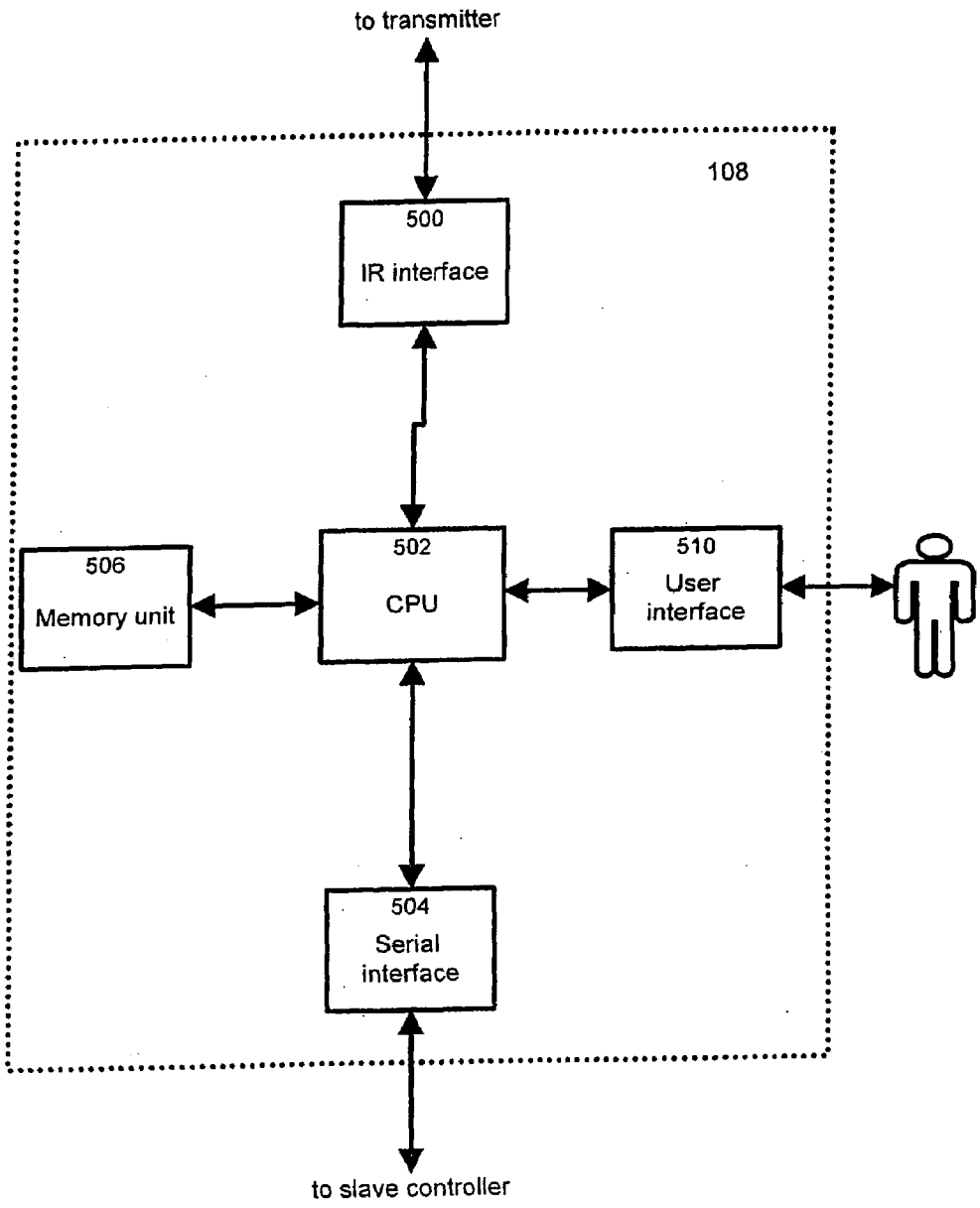
FIG. 5 shows a block diagram of the operator programming unit in accordance with the spirit of the invention.

As best shown in FIG. 5, the OPP comprises a memory unit 506 for storing identifier and programming information, a CPU 502, an IR interface 500, a serial interface 504 and a user interface 510. The CPU 502 interacts with the interfaces 500, 504 and the memory unit 506 to perform functionalities related to programming of the transmitter 104 and slave controller 106, as will be discussed later. The IR interface 500 is used to communicate with the transmitter 104 via the IR link 120. The serial interface 504 is used to communicate with the slave controller 106 via the serial communication link 126. Other interface configurations are possible without departing from the spirit of the invention. For example, both interfaces 500, 504 may be IR interfaces or both may be serial interfaces. Furthermore, a single interface may be used to communicate with both the transmitter and the slave controller. Other variations are possible and will be readily apparent to the person skilled in the act.

The user interface 510 is suitable for receiving instructions from an operator to program a given transmitter/slave controller pair.

Figure 3:
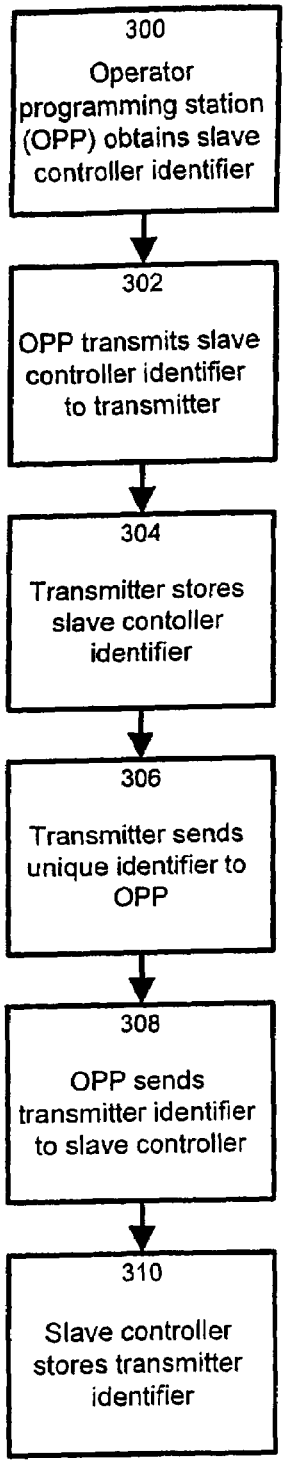
FIG. 3 shows a flow chart of a method in accordance with the invention for assigning a machine address to a transmitter unit.

In a typical interaction, as shown in FIG. 3, at step 300, the OPP 108 obtains the slave controller identifier via the communication link 126. This is effected by establishing a communication between the OPP 108 and the slave controller 106 over the communication link 126. During this transaction, the slave controller 106 transmits to the OPP 108 its identifier. At step 302, OPP then transmits the slave controller identifier to the transmitter 104 via the transmitter's IR interface 220. At step 304 the transmitter 104 receives the identifier information and stores it in the storage medium 208. Following this, at step 306 the transmitter 104 sends its unique identifier to the OPP 108. In a specific example the unique identifier is the transmitter's serial number stored on the storage medium 210. The OPP 108 receives the transmitter identifier and transmits it at step 308 to the slave controller 106. The slave controller 106 stores the transmitter's unique identifier on a storage medium 606 and the programming is complete. The next time the slave controller 106 receives a message it will check the tag to see if it contains the correct slave controller identifier and the correct transmitter unique identifier.

Figure 4:
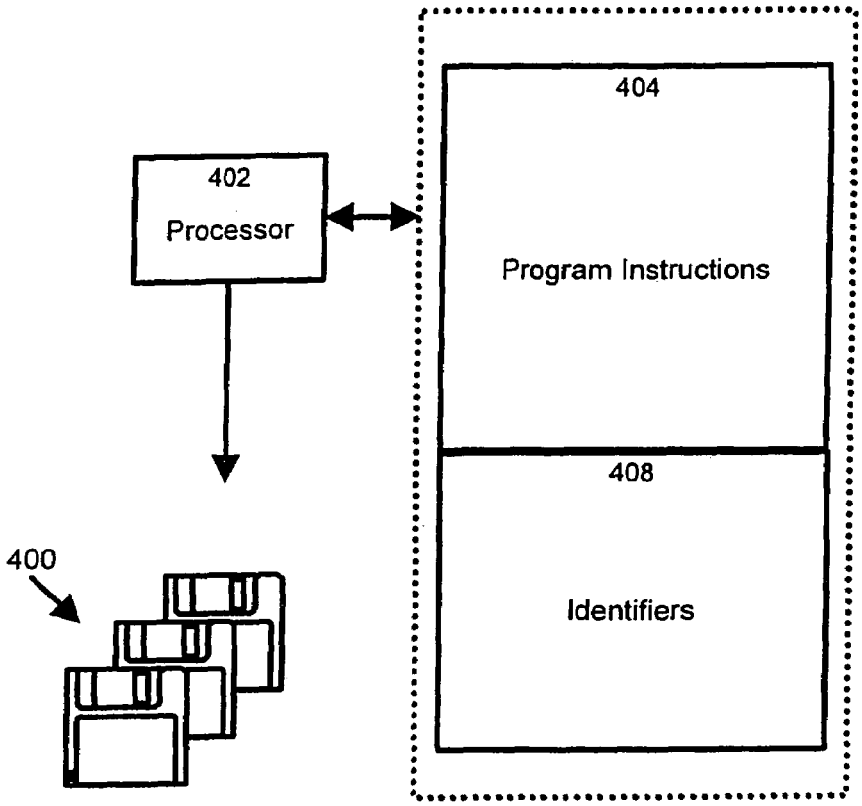
FIG. 4 is a structural block diagram of an apparatus in accordance with the invention for signal transmission in accordance with the invention.

In an alternative embodiment, the transmitter and slave controller identifiers may be randomly generated and sent to the respective components. The operations to generate the identifiers for the components of a communications system may be performed by a general-purpose digital computer using a CPU and memory means as shown in FIG. 4. Such computing platform typically includes a CPU 402 and a memory 400 connected to the CPU by a data communication bus. The memory 400 stores the data and the instructions of the program implementing the functional blocks depicted in the drawing and described in the specification. That program operates on the data in accordance with the algorithms to generate the unique identifiers. Preferably the algorithms operate such that to insure that the identifiers generated are unique. For example, the computing platform may store on a computer readable medium 401 the identifiers assigned thus far in a list, and may scan this list before assigning a new identifier to a component. The addresses are then loaded into PROMs in the transmitter 104 and the slave controller 106.

The steps depicted in FIG. 3 are implemented primarily by software. The program instructions for the software implemented functional blocks are stored in the memory unit 506.

Figure 6:
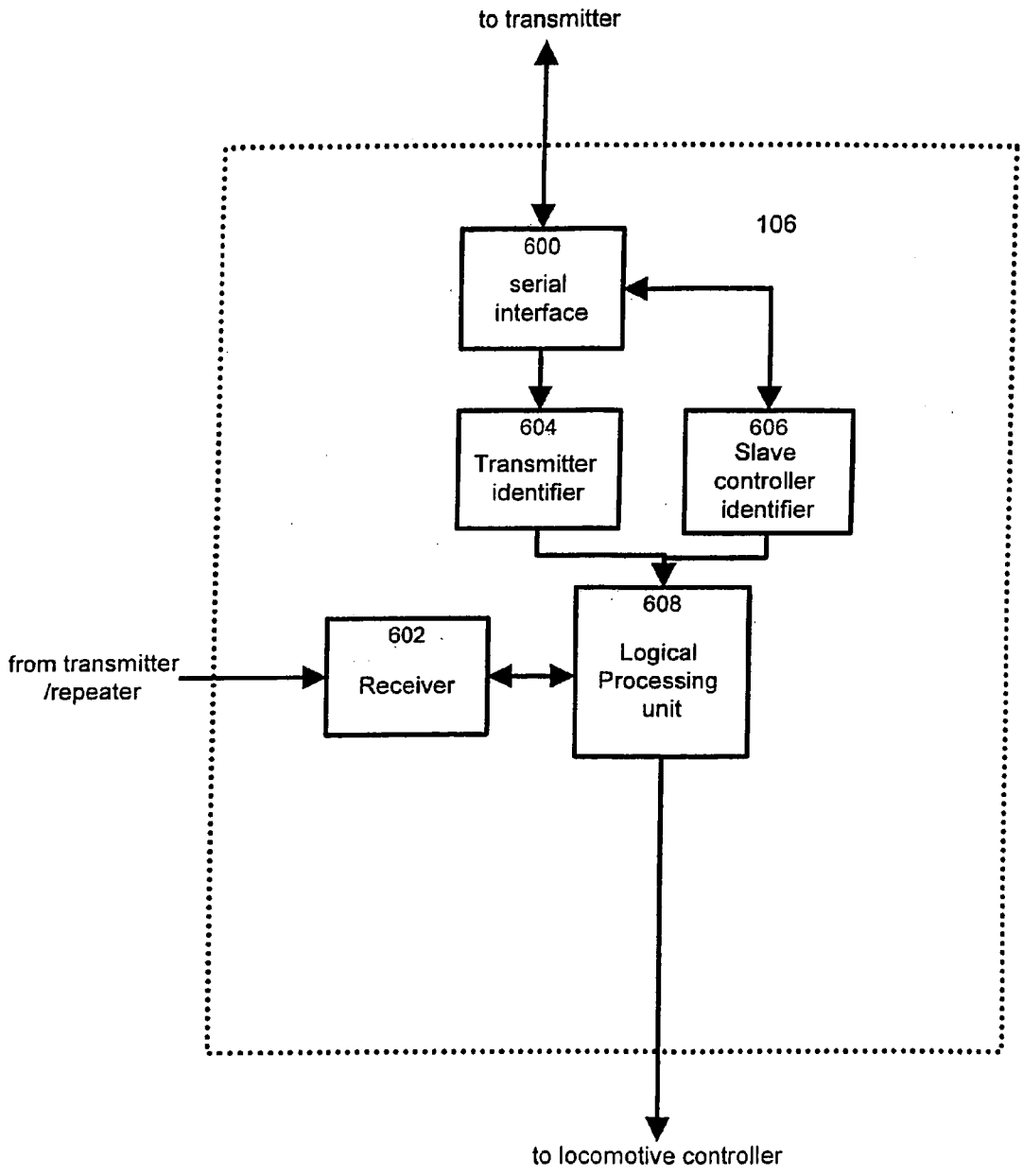
FIG. 6 shows a block diagram of the slave controller unit in accordance with the spirit of the invention.

As to the structure of the slave controller 106, as shown in FIG. 6, the latter comprises a receiver unit 602 that senses the signal transmitted by the transmitter 104. The slave controller 106 also comprises an interface 600 for interacting with the OPP 108. In a specific example the interface 600 is a serial interface. The serial interface 600 is coupled to storage media 604, 606 for storing the identifier of the transmitter unit associated with the slave controller 106 and for storage of the slave controller identifier. In addition, the slave controller 106 includes a logical processing station 608 to process the received signal and to generate the necessary control signals that are input to the locomotive controller module 112 so the desired command can be implemented. The logical processing station 608 also performs the validation of a message received at the receiver 602.

Although the present invention has been described in considerable detail with reference to certain preferred embodiments thereof, variations and refinements are possible without departing from the spirit of the invention as have been described throughout the document. Therefore, only the appended claims and their equivalents should limit the scope of the invention.

We claim:

1. A device for performing address synchronization between a transmitter and a slave controller of a remote control system for a locomotive, said device comprising a storage device operative to:

communicate with one of the transmitter and slave controller via a wireless communication link to receive and store an identifier of the one of the transmitter and slave controller;

communicate with the other of the transmitter and slave controller to:

transmit to the other of the transmitter and slave controller the stored identifier of the one of the transmitter and slave controller;

receive and store an identifier of the other of the transmitter and slave controller;

communicate with the one of the transmitter and slave controller to transmit to the one of the transmitter and slave controller the stored identifier of the other of the transmitter and slave controller.

2. A device as defined in claim 1, wherein said device further comprises an interface in communication with said storage device via which said storage device can communicate with the one of said transmitter and slave controller via the wireless communication link.

3. A device as defined in claim 2, wherein said interface is a first interface, said device further comprising a second interface in communication with said storage device through which said storage device can communicate with the other of said transmitter and slave controller.

4. A device as defined in claim 3, wherein said first interface is an IR interface and the wireless communication link is an IR link.

5. A device as defined in claim 4, wherein said second interface is a serial interface.

6. A device as defined in claim 1, comprising a CPU for controlling the communication between the storage device, the transmitter and the slave controller.

7. A device as defined in claim 1, comprising a user interface for receiving commands from an operator.

8. A device for use in a remote control system for a locomotive, the remote control system having a transmitter and a slave controller for mounting on board the locomotive, said device comprising:

a first interface for communication with the transmitter for receiving an identifier of the transmitter;

a second interface for communication with the slave controller for receiving an identifier of the slave controller;

one of said first and second interfaces communicating with the respective transmitter or receiver via a wireless communication link;

a data storage in communication with said first and second interfaces for storing the identifier of the transmitter and the identifier of the slave controller;

said data storage being operative to:

output the identifier of the slave controller for transmission to the transmitter via said first interface;

output the identifier of the transmitter for transmission to the slave controller via said second interface.

9. A device as defined in claim 8, wherein said first interface is an IR interface.

10. A device as defined in claim 8, wherein said second interface is a serial interface.

11. A device as defined in claim 8, including a user interface for receiving commands from an operator.

12. In combination:

a) a transmitter for remotely controlling a locomotive in which is mounted a slave controller, said transmitter comprising:

i) an interface for receiving an identifier of the slave controller via a first communication link, the first communication link being a wireless link;

ii) a data storage in communication with said interface for storing the identifier of the slave controller received via said first communication link, the data storage of said transmitter being further operative to store an identifier of said transmitter;

iii) a signal transmitting unit for transmitting a signal over a second communication link, the second communication link being a wireless RF communication link, the signal being indicative of at least one command for causing an action to be performed by the locomotive, the signal conveying information derived from the identifier of the slave controller received via the first communication link;

b) a device having a data storage for holding the identifier of the slave controller, said device being operative to communicate with said transmitter via the first communication link and said interface to transmit the identifier of the slave controller to said transmitter, wherein said transmitter is operative to release the identifier of said transmitter for transmission to said device via said interface and the first communication link.

13. A combination as defined in claim 12, wherein the data storage of said device is operative to store the identifier of said transmitter transmitted to said device via said interface and the first communication link.

14. A combination as defined in claim 13, wherein the first communication link is an IR link.

15. In combination:

a) a slave controller for mounting on-board a locomotive having a controller module, said slave controller having;

i) an interface for receiving an identifier of a transmitter via a first communication link, the first communication link being a wireless communication link;

ii) a data storage in communication with said interface for storing the identifier of the transmitter, the data storage of said slave controller being further operative to store an identifier of said slave controller;

iii) a signal receiver unit for receiving a signal from the transmitter over a second communication link, the second communication link being a wireless RF communication link, the signal conveying a message including a command portion indicative of at least one command for causing at least one action to be performed by the locomotive;

b) a device having a data storage for holding the identifier of the transmitter, said device operative to communicate with said slave controller to transmit the identifier of the transmitter to said slave controller, wherein the data storage of said slave controller is operative to release the identifier of said slave controller for transmission to said device.

16. A combination as defined in claim 15, wherein the data storage of said device is operative to store the identifier of said slave controller.

17. A combination as defined in claim 16, wherein said device communicates with said slave controller via a serial interface.

18. A method for performing synchronization between a transmitter and a slave controller of a remote control system for a locomotive, said method comprising:

a) communicating with the transmitter for receiving an identifier of the transmitter;

b) storing the received identifier of the transmitter in a data storage;

c) communicating with the slave controller for receiving an identifier of the slave controller;

d) storing the received identifier of the slave controller in the data storage;

e) outputting the identifier of the slave controller from the data storage for transmission to the transmitter;

f) outputting the identifier of the transmitter from the data storage for transmission to the slave controller;

g) wherein the communicating with one of the transmitter and the slave controller is effected over a wireless communication link.

19. A method as defined in claim 18, wherein the communicating with the transmitter is effected over an IR link.

20. A method as defined in claim 19, wherein the communicating with the slave controller is effected over a serial communication link.

* * * * *